US008939314B1

(12) United States Patent
Stahlberger et al.

(10) Patent No.: US 8,939,314 B1
(45) Date of Patent: Jan. 27, 2015

(54) METHOD FOR PRODUCING A PRESSURE VESSEL AND PRESSURE VESSEL

(71) Applicant: Progress-Werk Oberkirch AG, Oberkirch (DE)

(72) Inventors: Dirk Stahlberger, Achern (DE); Gerhard Mayer, Oberkirch (DE); Hubert Leible, Durbach (DE)

(73) Assignee: Progress-Werk-Oberkirch AG, Oberkirch (DE)

( * ) Notice: Subject to any disclaimer, the term of this patent is extended or adjusted under 35 U.S.C. 154(b) by 0 days.

(21) Appl. No.: 13/954,479

(22) Filed: Jul. 30, 2013

(51) Int. Cl.

| | |
|---|---|
| ***F17C 1/14*** | (2006.01) |
| ***B21D 51/24*** | (2006.01) |
| ***B21D 51/44*** | (2006.01) |

(52) U.S. Cl.

CPC . *F17C 1/14* (2013.01); *B21D 51/24* (2013.01); *B21D 51/44* (2013.01)

USPC ..... 220/581; 220/555; 220/674; 29/469

(58) Field of Classification Search

CPC ..... B60K 2015/03039; B60K 2015/03032; B60K 15/03177; B60K 15/03; B60P 3/243; B60P 3/24; B60P 3/22; F17C 13/06; F17C 2203/012; F17C 2203/011; F17C 2203/01; F17C 2209/232; F17C 2209/23; F17C 2209/221; F17C 2209/22; F17C 2209/227; F17C 1/08; F17C 1/02; B65D 1/24; B65D 1/18; B65D 1/44; B65D 1/42

USPC ..... 220/564, 562, 582, 581, 555, 553, 500, 220/674, 675, 669; 29/469, 428

See application file for complete search history.

(56) References Cited

U.S. PATENT DOCUMENTS

| | | | | |
|---|---|---|---|---|
| 4,015,071 | A | 3/1977 | Peet | |
| 5,704,512 | A | 1/1998 | Falk et al. | |
| 6,453,697 | B1 | 9/2002 | Harmer et al. | |
| 2006/0261073 | A1 | 11/2006 | Kanno | |
| 2009/0145909 | A1 | 6/2009 | Hausberger | |
| 2013/0284619 | A1 * | 10/2013 | Daley | 206/216 |

FOREIGN PATENT DOCUMENTS

| | | | |
|---|---|---|---|
| DE | 2625315 | A1 | 12/1976 |
| DE | 3706571 | A1 | 9/1988 |
| DE | 3737977 | A1 | 5/1989 |
| DE | 29909827 | U1 | 9/1999 |
| DE | 69229803 | T2 | 4/2000 |
| DE | 10212801 | C1 | 1/2003 |
| DE | 102006018639 | A1 | 10/2007 |
| DE | 102007000244 | A1 | 12/2008 |

* cited by examiner

*Primary Examiner* — Robert J Hicks

(74) *Attorney, Agent, or Firm* — Reising Ethington P.C.

(57) ABSTRACT

A vehicle pressure vessel and manufacturing method which uses a vessel main part, an arched base, an arched cover, and one or more cross-webs connecting opposite walls of the vessel main part. The vessel main part is open at its top and bottom over which the cover and base respectively fit to close the vessel main part in a pressure-tight manner. A groove is embossed in the cross-webs where they connect to the opposite walls of the vessel main part. The cover and base each have an attachment rim that fits into the grooves when the cover and base are connected to the vessel main part.

15 Claims, 3 Drawing Sheets

METHOD FOR PRODUCING A PRESSURE VESSEL AND PRESSURE VESSEL

BACKGROUND OF THE INVENTION

The invention relates to a method for producing a pressure vessel, in particular a pressure vessel for a vehicle. Further, the invention relates to a pressure vessel, in particular a pressure vessel for a vehicle.

More specifically, the invention relates to a pressure vessel for receiving and storing a medium under overpressure and a method for producing same.

A pressure vessel, in particular for a vehicle, is known from document DE 299 09 827 U1. This document discloses a pressure vessel for receiving and storing a medium under overpressure, comprising a vessel main part which is closed in a pressure-tight manner by an arched cover and an arched base. For this purpose, the cover at the cover end of the vessel main part and the base at the base end of the vessel main part are welded to the vessel main part. The vessel main part has a plurality of cross-webs which connect opposite wall segments of the wall of the vessel main part to one another in order to give the vessel main part the required pressure resistance.

In the case of the known pressure vessel, the vessel main part is finish-machined before mounting the cover and the base on the vessel main part. On the one hand, this process involves introducing grooves into the cross-webs in the respective transition regions thereof into the wall of the vessel main part. The grooves serve for the centred reception of the cover and of the base at the first and second openings of the vessel main part. Moreover, the vessel main part is adapted to the outer circumference of the cover attachment rim and of the base attachment rim in the region of the first opening and of the second opening in order to compensate for tolerances between the vessel main part and the cover and base.

The finish-machining processes on the vessel main part which have been described above are each accomplished by cutting, i.e. by the removal of material.

However, a finish-machining process on the vessel main part involving cutting is expensive and time-consuming, and this has a disadvantageous effect on the production process.

Moreover, a finish-machining process on the vessel main part involving the removal of material in order to introduce the grooves and for the above-described tolerance compensation to allow accurately fitting reception of the cover and base ele-ments is associated with a reduction in the wall thickness of the vessel main part. This reduction in wall thickness leads to weakening of the wall of the vessel main part, espe-cially in the cover and base attachment regions of the vessel main part, and this can result in a preferential breaking point or a possible lack of leaktightness in the vessel main part.

The above-described weakening of the wall of the vessel main part due to the finish-machining involving cutting must therefore be compensated by deliberate reinforcement of the wall, at least in the cover and base attachment regions. Here, the reinforcement of the wall should be provided either during the production of the vessel main part, by producing the vessel main part overall with a greater wall thickness, or introduced subsequently into the vessel main part, e.g. by deposition welding. Producing the vessel main part with a greater wall thickness disadvantageously leads to a higher weight of the pressure vessel and to higher costs for materials in the production of the pressure vessel. Subsequent reinforcement of the wall of the vessel main part is a time-consuming and expensive measure.

DE 102 12 801 C1 discloses a cooler for liquid media which is con-structed from a main profile and a plurality of webs arranged therein. In order to ensure a meandering flow of the liquid medium, the ends of the webs, which project beyond the longitudinal ends of the main profile, are pressed into the interior of the profile. The open ends of the main profile are then soldered to end plates and thus closed.

SUMMARY OF THE INVENTION

It is an object of the invention to provide a method for producing a pressure vessel, in particular for a vehicle, which can be carried out with high production accuracy and with a lower outlay in terms of materials, time and cost.

It is another object of the invention to provide a pressure vessel of the type stated at the outset which can be produced with high production accuracy and with a lower outlay in terms of materials, time and cost.

According to the invention, a method for producing a pressure vessel is provided, comprising the steps:

a) providing a vessel main part, which has a wall, a first opening at a first end, a second opening at a second end and at least one cross-web, which connects opposite wall segments of the wall of the vessel main part to one another, b) providing an arched cover and an arched base, wherein the arched cover has a cover attachment rim and the arched base has a base attachment rim, c) embossing, without cutting, a first and a second groove into the at least one cross-web at the first opening and introducing a third and fourth groove into the at least one cross-web at the second opening, wherein the grooves are embossed in respective regions of connection of the at least one cross-web to the opposite wall segments of the vessel main part, d) inserting the cover attachment rim into the grooves at the first opening and inserting the base attachment rim into the grooves at the second opening, e) securing the cover and the base on the vessel main part in the region of the first and second ends in order to close the vessel main part in a pressure-tight manner.

Further according to the invention, a pressure vessel for receiving and storing a medium under overpressure is provided, comprising a vessel main part having a wall and at least one cross-web connecting opposite wall segments of the wall to one another, and further comprising a first opening and a second opening, an arched cover closing the vessel main part at the first opening and having a cover attachment rim, an arched base closing the vessel main part at the second opening and having a base attachment rim, a first and a second groove in the at least one cross-web at the first opening in the vessel main part, the cover attachment rim being received in the first and second grooves, a third and a fourth groove in the at least one cross-web at the second opening in the vessel main part, the base attachment rim being received in the third and fourth grooves, the grooves being embossed, without cutting, in respective regions of connection of the at least one cross-web to the opposite wall segments.

In the case of the method according to the invention and of the pressure vessel according to the invention, the grooves for the centred reception of the cover and of the base are introduced into the at least one cross-web without cutting, more specifically by embossing. Embossing the grooves has the advantage that no material is removed during embossing, and therefore weakening of the material of the vessel main part is avoided.

In the context of the present invention, the term "groove" should be taken to mean a recess, the length of which can also be shorter than the width thereof.

As a result, it is possible to dispense with the additional use of reinforcing regions, at least in the region of the region of connection of the at least one cross-web to the opposite wall segments of the vessel main part, which is preferably produced as an extruded aluminium profile, thereby enabling the pressure vessel to be produced with a lower weight, at lower cost and with a reduced outlay on processing.

The grooves are preferably embossed into the at least one cross-web in such a way that centred reception of the cover attachment rim on the vessel main part at the first opening and of the base attachment rim on the vessel main part at the second opening is ensured.

This facilitates correctly positioned placement of the cover and of the base on the vessel main part.

In a preferred embodiment of the method according to the invention and of the pressure vessel according to the invention, the wall of the vessel main part is finish-sized by forming, without cutting, in the region of the first opening and of the second opening in order to adapt an inside of the wall to an outer circumference of the cover attachment rim and of the base attachment rim.

By means of this measure, any manufacturing tolerances of the vessel main part, of the cover and of the base are advantageously compensated, likewise without cutting, i.e. without removing material. Finish-sizing the vessel main part by forming without cutting has the advantage that weakening of the material of the wall of the vessel main part is avoided, thus eliminating the need for the vessel main part either to be produced with a greater wall thickness from the outset or for the wall thickness to be increased afterwards by the application of material. In combination with the embossed grooves, the pressure vessel according to the invention in this embodiment is particularly sparing of materials and can be produced at reasonable cost and with less expenditure of time.

Finish-sizing of the vessel main part by forming without cutting is preferably carried out by pressing the wall of the vessel main part, e.g. by pressing it from the outside in order to displace a wall segment inwards, and/or by pressing it from the inside in order to displace a wall segment outwards.

Finish-sizing ensures that the cover attachment rim and the base attachment rim can be received with an accurate fit into the attachment regions of the vessel main part which are predefined by the introduced grooves, on the one hand, and the inside of the wall, on the other hand, and this has an advantageous effect on the quality of attachment of the cover and of the base to the vessel main part.

In another preferred embodiment of the method and of the pressure vessel, the wall of the vessel main part is configured with a uniform wall thickness all the way round the perimeter.

It is advantageous here that the vessel main part can be produced at particularly low cost, in particular as an extruded aluminium profile. Moreover, it is ensured that the stresses acting on the wall of the vessel main part are distributed uniformly.

In another preferred embodiment of the method and of the pressure vessel, the cover and the base are joined to the vessel main part by a material joint, in particular a welded joint or an adhesive joint.

This measure has the advantage that the base and the cover can be joined to the vessel main part at low cost and in a pressure-tight manner by means of a welded or an adhesive joint.

In another preferred embodiment of the method, the grooves are formed with a bevelled shoulder in the form of a chamfer during embossing.

In the case of the pressure vessel, the grooves preferably have a bevelled shoulder in the form of a chamfer.

This measure advantageously facilitates the insertion of the cover attachment rim and the base attachment rim into the respective attachment regions formed by the grooves and the inside of the wall of the vessel main part. The chamfer is produced during the embossing of the grooves, thus advantageously eliminating an additional processing operation.

By means of the method according to the invention, the pressure vessel according to the invention can be produced at low cost, with a low weight and with a low reject rate in a series production process.

Further advantages and features will emerge from the following description and the attached drawing.

It is obvious that the features mentioned above and those which remain to be explained below can be used not only in the respectively indicated combination but also in other combinations or in isolation without exceeding the scope of the present invention.

BRIEF DESCRIPTION OF THE DRAWINGS

An illustrative embodiment of the invention is shown in the drawing and is described in greater detail with reference to the latter. In the drawing.

DESCRIPTION OF PREFERRED EMBODIMENTS

Figure 1:
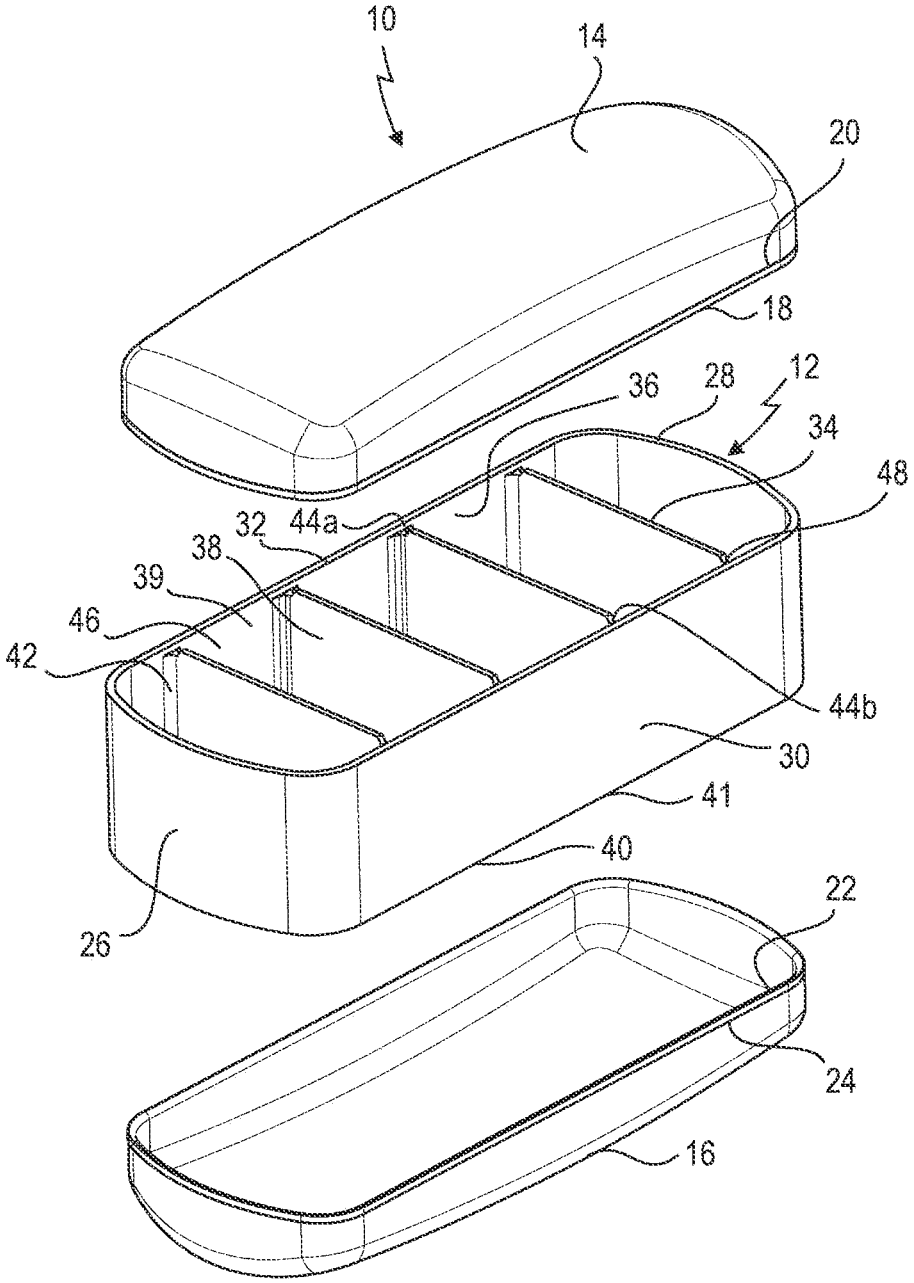
FIG. 1 shows a pressure vessel in an exploded perspective view.
Figure 2:
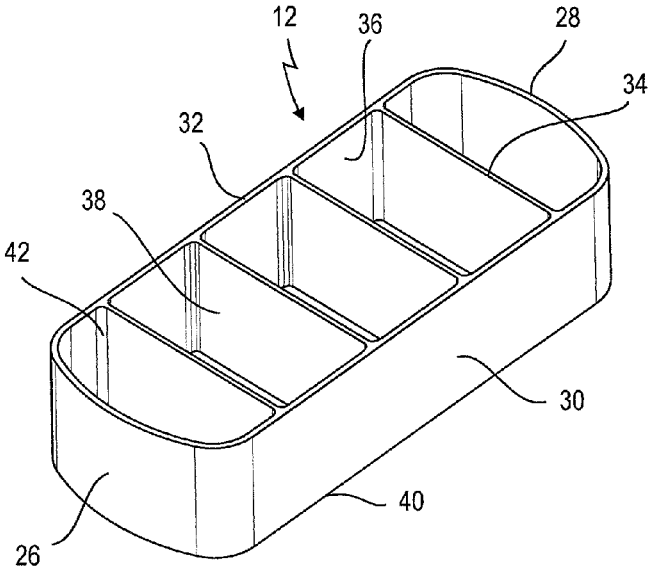
FIG. 2 shows, in perspective, a vessel main part of the pressure vessel in FIG. 1 in an intermediate stage of the production of the pressure vessel in FIG. 1.
Figure 3:
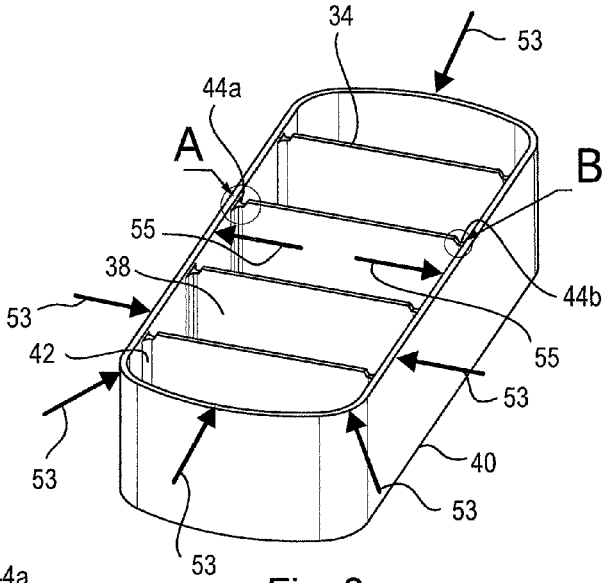
FIG. 3 shows, in perspective, the vessel main part in FIG. 2 in a further intermediate stage of the production of the pressure vessel.
Figure 4:
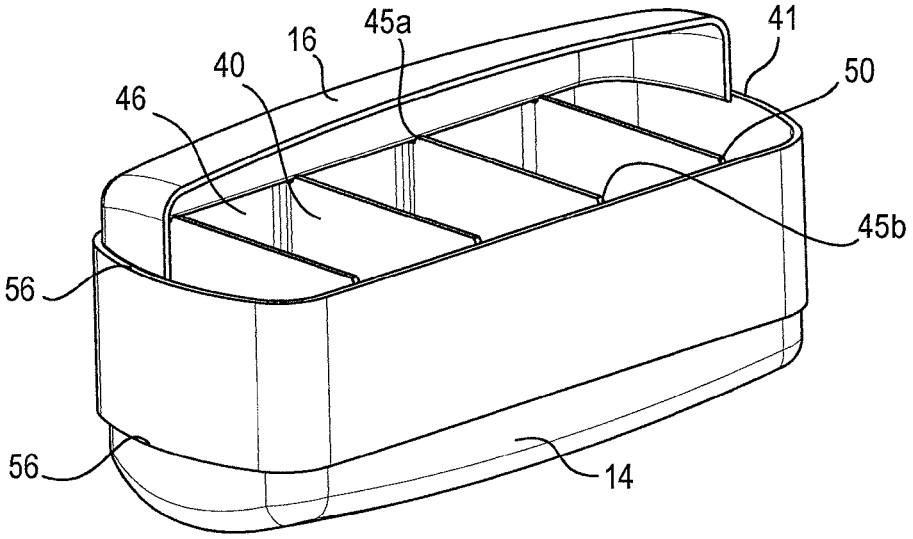
FIG. 4 shows, in perspective, the pressure vessel in FIG. 1 in partially sectioned view in the finished condition.

A pressure vessel provided with the general reference sign 10 is shown in an exploded view in FIG. 1. Further details of the pressure vessel 10 and of the production thereof are shown in FIGS. 2 to 4.

The pressure vessel 10 is used in a vehicle (not shown). The pressure vessel 10 is used in general to receive and store a medium under overpressure, which can be a gas, a liquid or steam. The pressure vessel 10 can be used as a storage and compensation tank for pneumatic control systems in motor vehicles, for example. One specific application is, for example, the use of the pressure vessel 10 as a compensation and storage tank for compressed air in a pneumatic chassis suspension system of a vehicle.

The pressure vessel 10 has a vessel main part 12 which, overall, is formed integrally of metal, in particular steel or aluminium sheet. The vessel main part 12 can have been produced, for example, by a cold forming method, in particular by extrusion.

The pressure vessel 10 furthermore has a cover 14 and a base 16, wherein both the cover 14 and the base 16 are of arched design. The shaping of the vessel main part 12, of the cover 14 and of the base 16 can fundamentally be matched in terms of the geometry and configuration thereof to the installation location at which the pressure vessel 10 is to be positioned. The arching of the cover 14 and the arching of the base 16 fundamentally ensure uniform pressure distribution at the surface of the cover and the surface of the base.

On the side facing the vessel main part 12, the cover 14 has a cover attachment rim 18, which extends along the entire circumference of a cover rim 20. On the side facing the vessel main part 12, the base 16 has a base attachment rim 22, which is formed along the entire circumference of a base rim 24.

The vessel main part 12 has a substantially box-shaped form, wherein the vessel main part 12 furthermore has arched ends 26, 28. Fundamentally, however, the vessel main part 12 can be configured in any desired box-shaped form which is matched to an installation location of the pressure vessel 10.

The vessel main part 12 has opposite lateral wall segments 30, 32, which are connected to one another by cross-webs 34. There are four cross-webs 34 in the embodiment shown. The vessel main part 12 thus has a wall 36 all around the circumference, being formed by the opposite wall segments 30, 32 and the wall segments of the arched ends 26, 28. It is self-evident that the number of cross-webs 34 can be less than four or indeed greater than four, depending on the size of the pressure vessel 10.

The cross-webs 34 which connect the opposite wall segments 30, 32 to one another extend in the vessel main part 12 from a cover-side first opening 38 at a first end 39 of the vessel main part 12, to a base-side second opening 40 at a second end 41 of the vessel main part 12.

In the embodiment shown, the individual cross-webs 34 are aligned so as to be straight and flat and parallel to one another. However, it is self-evident that the cross-webs 34 can also be arranged so as not to be parallel to one another.

Wall segments 30, 32 are formed integrally with the wall segments of the arched ends 26, 28 and the cross-webs 34. This can be achieved by producing the vessel main part 12 as an extruded profile made of metal, e.g. aluminium. The direction of extrusion is in the direction of the longitudinal extent of the cross-webs 34, i.e. in the direction of the connection between the cover-side first opening 38 and the base-side second opening 40. In this case, the vessel main part 12 can be produced as a meter-length extruded profile and then cut to length as required from this meter-length material.

Figure 3A:
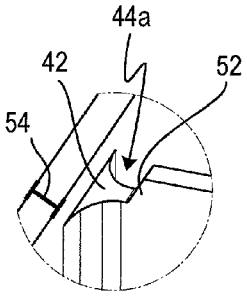
FIG. 3*a* shows a detail A in FIG. 3 on a larger scale than FIG. 3.
Figure 3B:
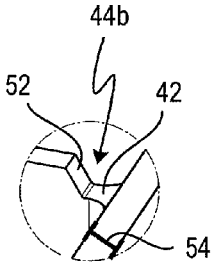
FIG. 3*b* shows a detail B in FIG. 3 on a larger scale than FIG. 3.

At wall segments 30, 32, the cross-webs 34 each have regions 42 of connection to the wall 36, said regions widening towards the walls 36 in a section plane orthogonal to the surface of the cross-webs 34 (cf. also FIG. 3*a*, FIG. 3*b*).

At the first opening 38, the cross-webs 34 each have a first groove 44*a* and a second groove 44*b*, which are introduced without cutting, by embossing (stamping), into the cross-webs 34 in the region of the respective regions 42 of connection of the cross-webs 34 to wall segments 30, 32. Moreover, the cross-webs 34 each have, at the second opening 40, further, third and fourth grooves 45*a*, 45*b* (see FIG. 4), which are introduced without cutting, by embossing, into the cross-webs 34 in the region of the regions 42 of connection of the cross-webs 34 to wall segments 30, 32. In this case, grooves 44*a* and 45*a* are situated opposite one another, as are grooves 44*b* and 45*b*. The embossed grooves 44*a*, 44*b*, 45*a*, 45*b*, on the one hand, and an inside 46 of the wall 36 of the vessel main part 12, on the other hand, result in first and second attachment regions 48, 50 at the cover-side first opening 38 and at the base-side second opening 40, said attachment regions receiving the cover attachment rim 18 of the cover 14 and the base attachment rim 22 of the base 16, respectively.

In FIG. 2, the vessel main part 12 of the pressure vessel 10 is shown in an intermediate stage of production. In the intermediate stage show in FIG. 2, the vessel main part 12 is provided as an extruded profile, wherein the grooves 44*a*, 44*b* and 45*a*, 45*b* have not yet been introduced into the cross-webs 34.

Starting from the stage in FIG. 2, the vessel main part 12 is shown in a subsequent stage of production in FIG. 3. At this stage, as explained above, the grooves 44*a*, 44*b*, 45*a*, 45*b* have been introduced into the cross-webs 34 of the extruded blank of the vessel main part 12 in the region of the cover-side first opening 38 and of the base-side second opening 40. The grooves 44*a*, 44*b*, 45*a*, 45*b* are embossed into the cross-webs 34 in respective regions 42 of connection of the cross-webs 34 to wall segments 30, 32. The grooves 44*a*, 44*b*, 45*a*, 45*b* are designed in such a way that they, on the one hand, and the inside 46 of the wall 36 of the vessel main part 12, on the other hand, form the first attachment region 48 for the cover attachment rim 18 at the cover-side first opening 38 and the second attachment region 50 for the base attachment rim 22 at the base-side second opening 40 of the vessel main part 12. In this case, the grooves 44*a*, 44*b*, 45*a*, 45*b* are designed in such a way that they can receive the cover attachment rim 18 and the base attachment rim 20 in a centred manner.

One of the grooves 44*a* is shown on an enlarged scale in FIG. 3*a*. One of the grooves 44*b* is shown on an enlarged scale in FIG. 3*b*. Grooves 44*a*, 44*b* and grooves 45*a*, 45*b* are introduced by embossing material of the cross-webs 34. During the embossing of grooves 44*a*, 44*b*, material of the cross-webs 34 is displaced in a direction from the first opening 38 towards the second opening 40. The embossing of grooves 45*a*, 45*b* takes place in the opposite direction, i.e. in a direction from the second opening 40 towards the first opening 38. As is evident from FIGS. 3*a* and 3*b*, grooves 44*a*, 44*b* have a substantially rectangular profile (and the same applies to grooves 45*a*, 45*b*). On the side thereof facing away from the wall 36, the grooves 44*a*, 44*b*, 45*a*, 45*b* have a bevelled shoulder 52 in the form of a chamfer, which makes it easier to insert the cover attachment rim 18 and the base attachment rim 22 into the grooves 44*a*, 44*b*, 45*a*, 45*b*.

It is self-evident that the profiles of grooves 44*a*, 44*b* and 45*a*, 45*b* can also have profile shapes which deviate from the profile shape shown. Thus, grooves 44*a*, 44*b* and 45*a*, 45*b* can also be of round or stepped design.

Embossing the grooves 44*a*, 44*b*, 45*a*, 45*b* ensures that the wall thickness 54 of the wall 36 is not reduced in the attachment regions 48, 50.

In order to adapt the inside 46 of the wall 36 to the outer circumference of the cover attachment rim 18 and to the outer circumference of the base attachment rim 22, the wall 36 of the vessel main part 12 is finish-sized by forming, without cutting, in the region of the first opening 38 and of the second opening 40, if such adaptation is required due to manufacturing tolerances during the production of the vessel main part 12, of the cover 14 and/or of the base 16.

Finish-sizing the vessel main part 12 by forming without cutting in the region of the first opening 38 and of the second opening 40 is accomplished by pressing the wall 36 of the vessel main part 12 in sections, namely inwards (e.g. arrows 53 in FIG. 3) and/or outwards (e.g. arrows 55 in FIG. 3), depending on whether the outer circumference of the vessel main part 12 has to be reduced or increased completely or in sections at the first opening 38 and at the second opening 40. By virtue of the finish-sizing by forming without cutting, the vessel main part 12 has a uniform wall thickness 54 over the entire circumference (see FIGS. 3*a* and 3*b*).

FIG. 4 shows the pressure vessel 10 in the finished stage. In contrast to FIG. 1, the pressure vessel 10 in FIG. 4 is shown with a view of the base 16, whereas FIG. 1 shows the pressure vessel 10 with a view of the cover 14. Moreover, in FIG. 4 the base 16 is shown cut away.

During the transition from FIG. 3 to FIG. 4, the cover 14 has been placed on the first opening 38 of the vessel main part 12, or, to be more specific, the cover attachment rim 18 has been inserted into grooves 44*a*, 44*b* of the cross-webs 34. During this process, grooves 44*a*, 44*b* bring about centring of the cover 14 on the vessel main part 12.

In the same way, the base 16 has been placed on the second opening 40 of the vessel main part 12, i.e. the base attachment rim 22 is inserted into grooves 45*a*, 45*b* of the cross-webs 34. Here too, grooves 45*a*, 45*b* bring about centring of the base 16 on the vessel main part 12.

The cover 14 and the base 16 are then welded to the vessel main part 12 in order to close the pressure vessel 10 in a pressure-tight manner. FIG. 4 shows the welding by means of weld seams 56, which extend around the entire circumference of the vessel main part 12.

It is also possible for the cover 14 and/or the base 16 to be connected to the vessel main part 12 by adhesive bonding instead of by welding.

What is claimed is:

1. A method for producing a pressure vessel, comprising the steps:

a) providing a vessel main part, which has a wall, a first opening at a first end, a second opening at a second end and at least one cross-web, which connects opposite wall segments of the wall of the vessel main part to one another, b) providing an arched cover and an arched base, wherein the arched cover has a cover attachment rim and the arched base has a base attachment rim, c) embossing, without cutting, a first and a second groove into the at least one cross-web at the first opening and introducing a third and fourth groove into the at least one cross-web at the second opening, wherein the grooves are embossed in respective regions of connection of the at least one cross-web to the opposite wall segments of the vessel main part, d) inserting the cover attachment rim into the grooves at the first opening and inserting the base attachment rim into the grooves at the second opening, e) securing the cover and the base on the vessel main part in the region of the first and second ends in order to close the vessel main part in a pressure-tight manner.

2. The method according to claim 1, further comprising finish-sizing by forming the wall of the vessel main part, without cutting, in the region of the first opening and of the second opening in order to adapt an inside of the wall to an outer circumference of the cover attachment rim and of the base attachment rim.

3. The method according to claim 2, wherein the finish-sizing is carried out by pressing the wall of the vessel part at least one of inwards and outwards.

4. The method according to claim 1, wherein the wall of the vessel main part is configured with a uniform wall thickness all the way round the perimeter.

5. The method according to claim 1, wherein the securing of the cover and the base comprises joining the cover and the base to the vessel main part by a material joint.

6. The method according to claim 5, wherein the joining comprises weld-joining.

7. The method according to claim 5, wherein the joining comprises adhesive-joining.

8. The method according to claim 1, wherein the embossing of the grooves comprises forming the grooves with a bevelled shoulder in the form of a chamfer.

9. A pressure vessel for receiving and storing a medium under overpressure, comprising a vessel main part having a wall and at least one cross-web connecting opposite wall segments of the wall to one another, and further comprising a first opening and a second opening, an arched cover closing the vessel main part at the first opening and having a cover attachment rim, an arched base closing the vessel main part at the second opening and having a base attachment rim, a first and a second groove in the at least one cross-web at the first opening in the vessel main part, the cover attachment rim being received in the first and second grooves, a third and a fourth groove in the at least one cross-web at the second opening in the vessel main part, the base attachment rim being received in the third and fourth grooves, the grooves being embossed, without cutting, in respective regions of connection of the at least one cross-web to the opposite wall segments.

10. The pressure vessel according to claim 9, wherein the wall of the vessel main part is finish-sized by forming, without cutting, in the region of the first opening and of the second opening in order to adapt an inside of the wall to an outer circumference of the cover attachment rim and of the base attachment rim.

11. The pressure vessel according to claim 9, wherein the wall of the vessel main part has a uniform wall thickness all the way round the perimeter.

12. The pressure vessel according to claim 9, wherein the cover and the base are joined to the vessel main part by a material joint.

13. The pressure vessel according to claim 12, wherein the cover and the base are joined to the vessel main part by a welded joint.

14. The pressure vessel according to claim 12, wherein the cover and the base are joined to the vessel main part by an adhesive joint.

15. The pressure vessel according to claim 9, wherein the grooves have a bevelled shoulder in the form of a chamfer.

* * * * *